United States Patent [19]

Myers et al.

[11] Patent Number: 4,628,983

[45] Date of Patent: Dec. 16, 1986

[54] METHOD AND APPARATUS FOR MAKING HOLLOW SHEEL CORES WITH CONTROLLED GAS FLOW

[75] Inventors: Gary L. Myers, Gilead; Don R. Jagger, Galion, both of Ohio

[73] Assignee: HPM Corporation, Mount Gilead, Ohio

[21] Appl. No.: 695,941

[22] Filed: Jan. 29, 1985

[51] Int. Cl.[4] ..... B22C 13/08

[52] U.S. Cl. ..... 164/7.1; 164/16; 164/160.2; 164/165

[58] Field of Search ..... 164/7.1, 7.2, 12, 15, 164/16, 160.2, 165, 166

[56] References Cited

U.S. PATENT DOCUMENTS

| | | | |
|---|---|---|---|
| 3,528,481 | 10/1968 | Lund | 164/16 |
| 3,556,195 | 6/1968 | Lund | 164/16 |
| 3,587,709 | 6/1971 | Miller et al. | 164/12 |
| 3,888,293 | 6/1975 | Laforet et al. | 164/16 |
| 4,089,363 | 5/1978 | Dunlop | 164/16 |
| 4,103,729 | 8/1978 | Dunlop | 164/16 |
| 4,129,165 | 12/1978 | Edwards | 164/16 |
| 4,132,260 | 1/1979 | Luber | 164/16 |
| 4,190,097 | 2/1980 | Allread et al. | 164/16 |
| 4,232,726 | 11/1980 | Michelson | 164/16 |
| 4,248,288 | 2/1981 | Michelson | 164/16 |
| 4,291,740 | 9/1981 | Michelson | 164/16 |
| 4,311,184 | 1/1982 | Michelson | 164/16 |
| 4,312,397 | 1/1982 | Harris et al. | 164/16 |
| 4,390,056 | 6/1983 | Grove et al. | 164/7.1 |

FOREIGN PATENT DOCUMENTS

| | | | |
|---|---|---|---|
| 2088261 | 6/1982 | United Kingdom | 164/16 |
| 2110578 | 6/1983 | United Kingdom | 164/16 |

*Primary Examiner*—Nicholas P. Godici
*Assistant Examiner*—Richard K. Seidel
*Attorney, Agent, or Firm*—Jeffers, Irish & Hoffman

[57] ABSTRACT

An apparatus and method for making hollow shell cores wherein a core box assembly is provided including a vented pattern. Baffles are provided in the core box in the space between the pattern and the core box walls whereby a catalyst gas flowing into the core box through an entry port will be caused to enter the pattern and to flow along the outer layer of a sand and binder change in the pattern. The gas will then be caused to flow out of the pattern into a trapped gas vent and out of an outlet port of the core box. The continuous flow of catalyst gas through only the outside layer of the sand and binder charge in the pattern will only cause the outer layer of the charge to be cured and to form a hardened shell. After formation of the shell, the uncured sand and binder mixture in the shell will be discharged and reused. The shell is then transferred from the core box assembly.

27 Claims, 14 Drawing Figures

METHOD AND APPARATUS FOR MAKING HOLLOW SHEEL CORES WITH CONTROLLED GAS FLOW

BACKGROUND OF THE INVENTION

This invention pertains to a method and apparatus for producing hollow shell foundry cores from granular material by means of a heatless process which employs a catalytic gas.

Many processes have been developed for producing foundry cores including processes to form solid cores and shell cores. Since solid cores require more material and are heavier and more difficult to handle it is desired to produce hollow shell cores which have the advantage of being lighter in weight than solid cores and also require less material, and are therefore more economical to produce.

A process known as the Kroning process was developed during World War II whereby a thermosetting resin is utilized as a binder for granular material such as sand in producing hollow shell cores. The sand granules are precoated with the resin which contains a catalyst and lubricants. This process has a serious drawback due to the fact that the resin utilized hardens only with the application of heat. This is undesirable due to the large amount of fuel required in the production of hollow shell cores. With the increase in the cost of energy and fuels, this process has become uneconomical. Additionally, the core boxes employed with the Kroning process need to be of suitable construction in order to be able to withstand the high temperatures employed in the process. A further disadvantage of the Kroning process is the need for long curing times in the production of shell cores. It is therefore desired to provide a process for manufacturing hollow shell foundry cores wherein no heat is required and wherein the cycle time for the production of cores is relatively short.

Processes have been developed for producing shell cores with a heatless process wherein a pressure differential is created within a mold box or a gassing chamber by the introduction of catalyst gas after shaping the bindercoated sand in a vented pattern. One such process is disclosed in U.S. Pat. No. 4,089,363. The pressure differential generated is required in order to cause the catalyst gas to penetrate the shaped sand mass to the desired depth to create a shell of sufficient thickness. The disadvantage of these processes wherein such pressure differentials are utilized is that they are relatively time consuming and require costly equipment. Another disadvantage of this type of process is that air bubbles may be trapped in the outer layer of the sand mass, thereby causing weak areas in the shell. It is therefore desired to provide a heatless process for producing hollow shell foundry cores having a uniform wall thickness.

A yet further process has been developed for forming hollow shell foundry cores without the addition of heat by means of binder coated sand and a catalyst gas wherein special porous patterns are provided so that gas can flow through the pores of the pattern walls. One patent disclosing such a process is U.S. Pat. No. 4,291,740. In this process a core box is sealed after a sand and binder mixture has been introduced into the pattern and a catalyst gas is then applied through an inlet port in the core box wall. The gas is applied at greater than atmospheric pressure and will therefore flow through the porous walls of the pattern and penetrate into the sand and binder mixture within the pattern. The gas will exert a uniform pressure on the entire surface area of the shaped sand and binder mass enclosed in the pattern. The catalyst gas, due to its being pressurized, will penetrate a distance into the sand and binder material determined by the relative gas pressures. Equilibrium will be achieved between the applied catalyst gas at high pressure and the resisting pressure developed by the trapped air enclosed by the sand and binder mixture. During penetration and diffusion of the catalyst gas through the outer layer of the sand and binder mixture, hardening or curing thereof is effectuated and a hollow core is produced with a wall thickness determined by the extent of catalyst gas penetration. The process of diffusion and penetration of the catalyst gas through the outer layer of the sand and binder mixture is relatively slow since the process is static and time is required for equilibrium to be reached and for the catalyst molecules to penetrate the sand and binder layer. Therefore, the cycle time required to produce a hollow shell core is relative long, which is undesirable. Another undesirable aspect of this process is the fact that the entire pattern must be porous for the catalyst gas to reach the entire outer layer of the sand and binder mixture contained in the pattern. Such patterns are relatively expensive to manufacture. It is therefore desired to provide a method and apparatus for manufacturing hollow shell cores with reduced cycle time and patterns which are less expensive to manufacture.

U.S. Pat. No. 4,311,184 discloses a type of pattern to be used with the porous pattern process as disclosed in U.S. Pat. No. 4,291,740. An alternative pattern is also disclosed wherein apertures are formed in the pattern walls and porous metal elements are inserted in these apertures. During the formation of hollow shell cores in a process utilizing this type of pattern the gas penetrates these porous inserts under superatmospheric pressure of the catalyst gas and reacts with the binder coated sand in the pattern. As explained hereinabove, the process by which the catalyst gas permeates the sand and binder mass in the pattern is by a static diffusion process. As described in both this patent and the '740 patent, equilibrium must be achieved between the incoming pressurized gas and the air trapped in the sand and binder mixture. Thus, the relatively slow diffusion process of the catalyst molecules into the outer layer of the sand and binder mixture occurs after the static conditions have been established between the catalyst gas and the air trapped in the sand and binder mixture. Additionally, since many catalyst molecules will be stripped from the carrier immediately after the catalyst gas contacts the outermost layer of the sand and binder mixture, substantial time is required for additional molecules to travel beyond this outermost layer and penetrate further into the sand and binder mixture contained in the pattern. A further disadvantage of this process is that only the areas of the sand and binder mass immediately surrounding each aperture will have sufficient gas diffused therethrough to completely react with the binder coated sand. Thus, the shell will in effect be formed of hardened lumps of material which are interconnected with thinner areas. This results in an uneven thickness of the hollow shell foundry cores produced by this process. If it were desired to strengthen the shell the curing step could be made longer for more and deeper penetration of the gas into the sand and binder mixture. This is undesirable since the cycle time would thereby be increased. Alternatively, the catalytic gas pressure could be increased, which is also undesirable as it would require equipment which can withstand the higher pressures.

Another embodiment disclosed in U.S. Pat. No. 4,311,184 discloses a further step in the production of hollow shell foundry cores. A continuous flow of gas is established between an inlet and an outlet so that catalyst gas is directed along the pattern section. The continuous flow allows molecular diffusion between the gas and the air enclosed by the sand mass to cause hardening of the areas of the binder coated sand immediately contiguous to the working surface of the pattern section. In this step also, the process for the penetration of the catalyst molecules into the layer of the sand and binder mixture is by diffusion, which, as explained hereinbefore, is by its very nature a slow process. It is therefore desired to provide a process and apparatus for the heatless production of hollow shell foundry cores which is relatively fast and forms a hollow foundry core shell which has a uniform wall thickness of adequate strength.

SUMMARY OF THE INVENTION

The present invention, in one form thereof, overcomes the disadvantages of the above described prior art hollow shell core forming apparatuses and processes by providing an improved apparatus and method therefor. The method according to the present invention is a dynamic process and comprises the utilization of apertured core patterns having gas inlets and outlets and causing the catalyst gas to flow through the apertures of the pattern and adjacent the walls thereof to establish a laminar flow to thereby form a hollow shell foundry core with a relatively uniform wall thickness in a short amount of time.

The present invention, in one form thereof, provides a core box and pattern assembly wherein the inlet and outlet ports for the catalyst gas are spaced apart and wherein baffles are provided in the space between the pattern and the core box intermediate the inlet and outlet ports whereby the catalyst gas flowing into the core box through the inlet port is caused to flow into the pattern through vents or apertures in the walls thereof and then to flow along the inside of the pattern walls toward the outlet port.

The invention overcomes the disadvantages of the prior art processes because a laminar flow of gas is provided in the outer layer of the sand and binder mass contained in the pattern. Whereas the prior art apparatus and processes use a static process wherein equilibrium between the catalyst gas and the air trapped within the sand and binder mass must first be established and wherein a slow diffusion of catalyst molecules into the sand and binder mixture takes place, the instant invention provides a dynamic process wherein a continuous flow of catalyst gas through the outer layer of the sand and binder mixture is provided and which continues to supply fresh catalyst molecules to react with the sand and binder mixture to cause curing thereof. Thus, by modifying the tooling to strategically place apertures or vents in the pattern to cause catalyst gas flow through the pattern vents toward a trapped gas vent and by locating the baffles in the core box assembly to cause the gas to flow along the inside of the pattern walls in a laminar flow and by such flow to traverse substantially the entire surface area of the sand and binder mixture contained in the pattern, good contact is established in the outer layer of the sand and binder mass and uniform curing in a small amount of cycle time is ensured. A control valve may be provided in the outlet port to cause the flow of catalyst gas to be sufficiently slow to achieve proper curing and optimum utilization of the catalyst gas in the desired amount of time.

One advantage of the process according to the instant invention is the formation of hollow shell foundry cores with a heatless process.

Another advantage of the process according to the instant invention is reduced cycle time and more rapid processing of hollow shell foundry cores.

A still further advantage of the process according to the instant invention is the formation of a hollow shell foundry core having a uniform thickness and therefore having adequate strength.

Yet another advantage of the process according to the instant invention is that substantially the entire surface of the sand and binder mixture contained in the pattern will be contacted by the catalyst gas during the flow of gas through the pattern thereby eliminating trapped air bubbles in the skin of the sand and binder mixture and resulting in a uniform shell which contains no weak areas.

Still another advantage of the process of the instant invention is that gas will be continuously supplied and will flow through the outer layer of the sand charge so that sufficient catalyst molecules are available to completely cure the entire outside layer of the sand and binder mixture.

A yet further advantage according to the process of the instant invention is that the process does not require porous patterns for the production of hollow shell foundry cores with a heatless process.

The invention, in one form thereof, provides a method for producing a hollow foundry core shell in a pattern wherein the hollow pattern is first invested with a charge of sand and binder mixture. The catalyst gas is then introduced into the pattern through an inlet port. A flow of the gas is established along the inside of the pattern walls through only the outer layer of the charge, to thereby cure the outer layer of the charge and form a hollow shell. The gas flows out of an outlet port in the pattern. The uncured sand and binder mixture is then removed from the shell and the shell is ejected from the pattern.

The invention, in one form thereof, also provides a method for producing a hollow foundry core shell by providing a sealable core box assembly including a core box and a pattern, the walls of the pattern including apertures and the walls of the core box including inlet and outlet ports for permitting ingress and egress of a catalyst gas into the assembly. The pattern is then invested with binder coated sand and the core box assembly is sealed. Gas is introduced through the inlet port and the gas is caused to flow through the apertures into the pattern to cure only the outside layer of the binder coated sand contained in the pattern and to cause the gas to flow out of the outlet port. The uncured binder coated sand is then removed from the shell and the hollow shell is ejected from the pattern.

The invention, in one form thereof, furthermore comprises a method for making a hollow foundry core comprising providing a hollow core box and pattern assembly, the walls of the pattern including apertures therein to permit gas to pass through the walls. Inlet and outlet ports are provided in the walls of the core box and the space between the walls of the core box and the pattern is formed into plurality of sections. The pattern is invested with a sand and binder mixture through an investment opening and the investment opening is then sealed. A catalyst gas is admitted into the core box assembly through the inlet port. The outlet port is then opened to permit gas to flow continuously through a laminar region inside the pattern and adjacent the pattern walls to cure the outer layer of the sand and binder mixture contained in the pattern.

The invention, in one form thereof, yet further comprises a core box assembly for forming hollow foundry shell cores comprising a core box and a pattern located in the core box, the walls of the pattern including apertures for permitting a catalyst gas to pass through the walls. Inlet port means and outlet port means are provided in the walls of the core box and baffle means is provided in the core box intermediate the inlet and outlet ports for causing a catalyst gas, upon entering the inlet port, to flow into the pattern and along the pattern walls and out of the pattern into the core box and out of the outlet port.

The invention, in one form thereof, still further comprises a core box and pattern assembly for the heatless production of hollow shell cores comprising a sealable core box and a pattern located in the core box and spaced from the core box walls. The walls of the pattern are constructed to permit a gas pass therethrough. Inlet and outlet port means are provided in the core box walls for establishing a flow path for gas through the core box assembly. Baffle means is located in the space between the pattern walls and the core box walls and divides the space into sections. The flow path for the gas includes a space inside the pattern and immediately adjacent the pattern walls.

It is an object of the present invention to provide a process and apparatus for the formation of hollow shell foundry cores having reduced cycle time.

It is a still further object of the present invention to provide a process and apparatus for the formation of hollow shell foundry cores wherein the shells are of uniform thickness and of improved strength.

It is a yet further object of the present invention to provide a process and an apparatus for the formation of hollow shell foundry cores wherein no heat is used in the production of foundry shell cores.

It is yet another object of the present invention to provide a process for making hollow shell cores wherein a continuous flow of gas is established through the outer layer of a sand and binder mass contained in a pattern.

It is a still further object of the present invention to provide a process wherein formation of hollow shell foundry cores is not dependent upon diffusion of a catalyst gas under static pressure through a sand and binder mix- ture.

It is an object of the present invention to provide a method and apparatus for the formation of hollow shell foundry cores in a heatless process without the use of porous walled patterns.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
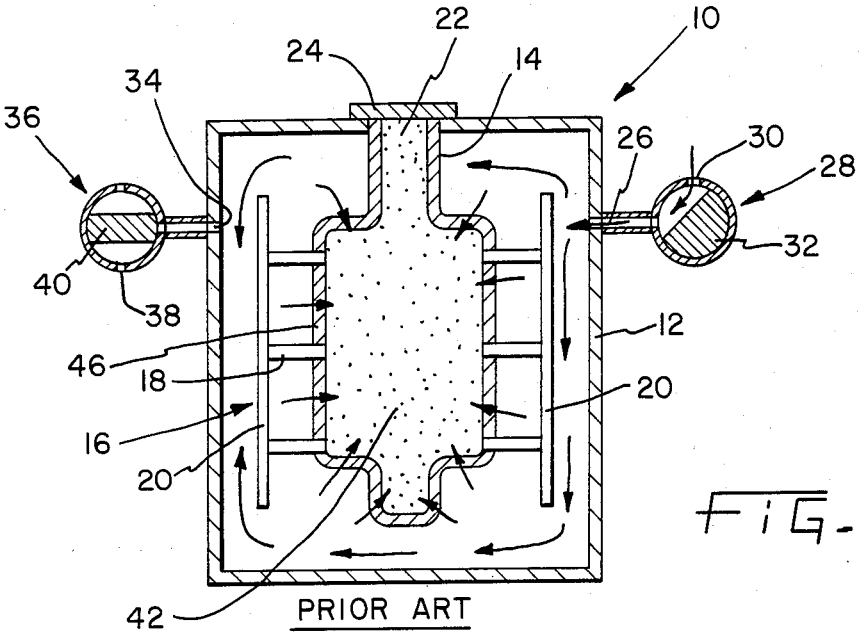
PRIOR ART FIG. 1
FIG. 1 is a sectional view of a prior art core box and pattern assembly.

Referring to FIG. 1 a prior art core box assembly 10 is shown comprising a core box 12 and a pattern 14 having an investment opening 22 therein. The assembly is also provided with an ejector mechanism 16 including ejector pins 18 and ejector plates 20 for ejecting finished shell cores from the pattern after formation thereof. A seal 24 is provided for sealing the investment opening after an investment step is completed wherein a sand and binder mixture 42 is invested into pattern 14. An inlet port valve assembly 28 is provided for inlet port 26. Valve assembly 28 includes a valve entry port 30 through which a catalyst gas is admitted into core box assembly 10. Valve assembly 28 also includes an inlet valve 32 for controlling the flow of catalyst gas into core box assembly 10. Outlet port valve assembly 36 is provided for outlet port 34. Valve assembly 36 includes a valve outlet port 38 and a valve member 40 for controlling the flow of gas and air through valve assembly 36.

Figure 2:
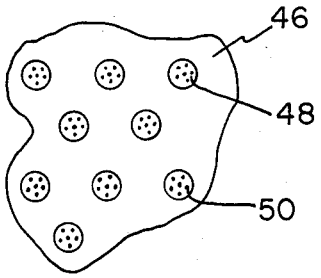
PRIOR ART FIG. 2
FIG. 2 is a sectional broken-away view of the wall of a prior art pattern.

As more fully described in U.S. Pat. No. 4,311,184, the walls 46 of Prior Art pattern 14 are preferably porous or, as shown in FIG. 2 have apertures 50 formed therein into which are inserted porous metal elements 48. In operation valve assembly 28 is adjusted to establish fluid communication between a source of supply of catalyst gas (not shown) and inlet port 26. The admission of the catalyst gas occurs at a pressure greater than atmospheric pressure. Core box 12 is sealed by means of sealing means 24 and outlet port valve assembly 36 is maintained open for a brief period of time immediately subsequent to introduction of the catalyst gas through inlet 26. Valve 40 is maintained opened until the air within the core box assembly is flushed from the interior spaces of the core box assembly and the air exits through outlet port valve assembly 36. Valve member 40 is then adjusted to close valve assembly 36 so that no further gas can flow out of outlet port 34. Catalyst gas floods the interior of the core box assembly and surrounds porous pattern 14. Upon the introduction of the catalyst gas through inlet port 26 at a pressure greater than atmospheric pressure, pressure is exerted against the trapped enclosed air volume in sand and binder mixture 42. The catalyst gas, due to its being introduced at a higher pressure will penetrate through porous inserts 48 and diffuse into the sand and binder mixture a distance which is determined by the equilibrium which is achieved between the applied catalyst gas pressure and the resisting pressure of the air enclosed in the sand and binder mixture 42. Therefore, at the center of the sand and binder mixture 42 an air bubble will develop which is surrounded by catalytic gas.

Figure 3:
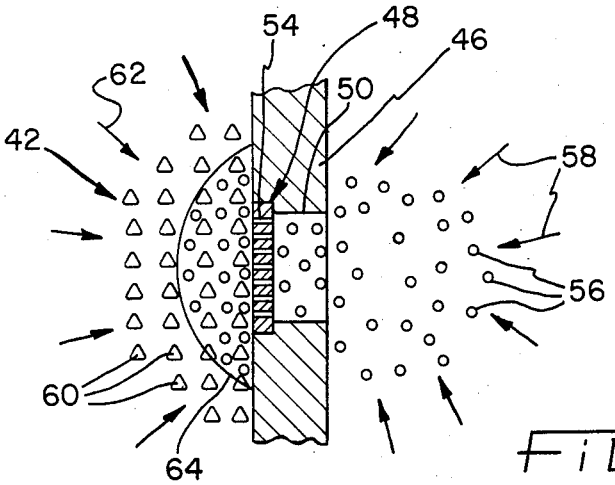
PRIOR ART FIG. 3
FIG. 3 is an enlarged broken-away diagrammatic sectional representation of the operation of a prior art pattern wall.

By referring to FIG. 3 an enlarged section 52 of the walls 46 of pattern 14 is shown. Aperture 50 is shown having located therein porous inserts 48 including pores 54. Gas molecules 56 are shown surrounding aperture 50 as they travel through pores 54 into the sand and binder mixture 42. Binder coated granular sand particles 60 of sand and binder mixture 42 are shown. It can be seen that the area immediately adjacent the pattern wall and surrounding aperture 50 and insert 54 will contain catalyst gas molecules as the pressure exerted by the catalyst gas reaches static equilibrium with respect to the air volume trapped in the sand and binder mixture. A semicircle 64 has been drawn in FIG. 3 to illustrate the penetration pattern of the catalyst molecules into the sand and binder mixture. Arrows 62 indicate the opposing pressure of the air volume inside the sand and binder mixture 42 which counteracts the pressure indicated by arrows 58 exerted by the catalyst gas molecules.

It can be readily understood that, since the entry of the catalyst gas molecules 56 into the sand and binder mixtures is accomplished by diffusion and the equalization of pressures, the catalyst gas will have its deepest penetration into the sand and binder mixture 42 immediately adjacent apertures 50 in pattern wall 46. Therefore, the wall thickness of the cured shell will be uneven and, if apertures 50 are spaced apart too far, areas will exist between apertures 50 wherein no curing will take place. Alternatively, if more complete curing is desired additional curing time could be allowed or the gas pressure could be increased for greater diffusion. Both of these alternatives are undesirable since the one requires more cycle time and the other requires well sealed fixtures which can withstand high pressure. Another alternative is to use a pattern having walls which are completely porous throughout. While the use of such completely porous patterns would improve the uniformity of the shell wall thickness, the basic method of curing with this process would still be by static diffusion which, as discussed hereinabove, is a slow process. Gas pressure equilibrium would first have to be achieved and the catalyst molecules would have to diffuse slowly through the outer layer of the sand and binder mixture in the pattern to cure the binder. Additionally, as pointed out above, patterns having completely porous walls are expensive to manufacture and are therefore undesirable.

Figure 4:
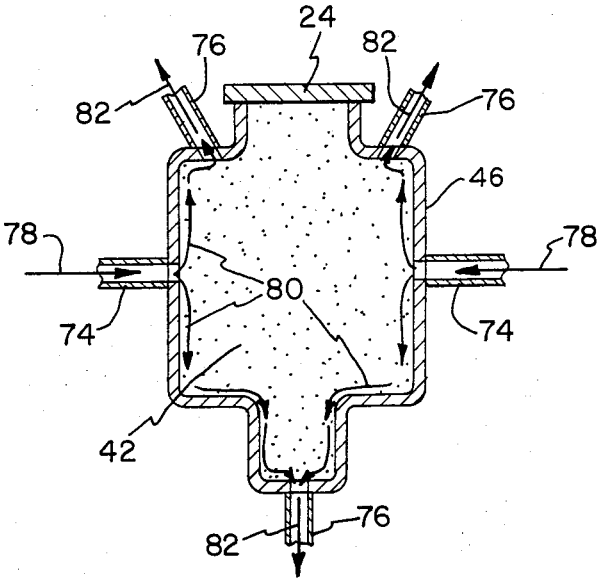
FIG. 4 is a schematic diagram of a pattern including the porting therefor.

Referring now to FIG. 4 a diagrammatic showing of the operation of the process according to the present invention is disclosed. A pattern 14 is shown including inlet ports 74 and outlet ports 76 whereby a laminar flow of catalyst gas is established inside the pattern as indicated by arrows 80. Catalyst gas is caused to flow into ports 74 as shown by arrows 78 and along the inside of walls 46 of pattern 14 as shown by arrows 80 and out of outlet ports 76 as shown by arrows 82. As further discussed hereinbelow, by establishing a dynamic laminar flow of gas as shown, substantially the entire layer of binder coated sand at the outer surface of the volume of binder coated sand 42 contained in pattern 14 will be contacted by catalyst gas and will be cured in a relatively short amount of time.

The gas flowing through inlet port 74 will flow toward outlet port 76 by way of the path of least resistance. By properly positioning the inlet ports and the outlet ports for the particular pattern design, the gas can be caused to flow along the entire outer surface of the sand and binder mass contained in the pattern as shown by arrows 80. By continuously supplying gas and by having this gas flow in a laminar layer through the outside layer of the sand and binder mass 42, catalyst molecules are continuously carried through this outer layer where they are stripped from the carrier by chemical reaction and are held chemically until the reaction is completed. Thus, the catalyst molecules are moved in controlled fashion about the outer layer of the sand and binder mass 42 contained in pattern 14, and a shell wall of desired thickness is produced in a much shorter cycle time as compared to the prior art processes. The reason for this is that fresh catalyst molecules are rapidly carried by the gas flow to the areas to be cured and that adequate quantities of catalyst molecules are continuously supplied to those areas.

Figure 5:
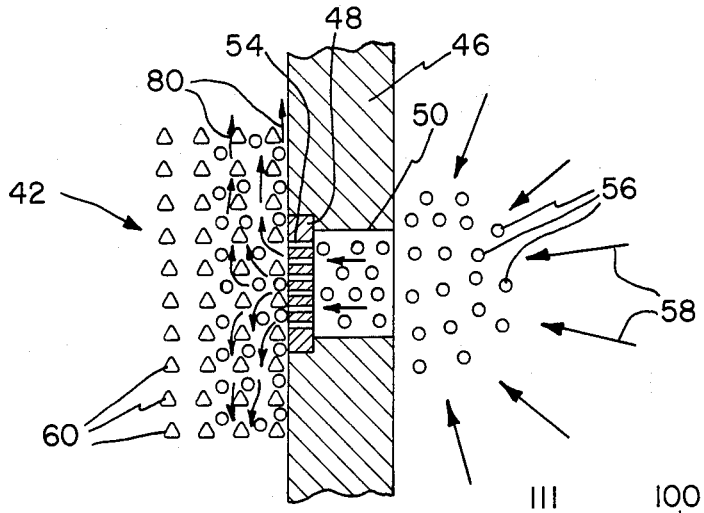
FIG. 5 is an enlarged diagrammatic broken-away sectional view of a portion of a pattern wall.

By referring to FIG. 5 an enlarged sectional view of the operation of the instant invention is disclosed. The pattern walls 46 contain apertures 50 through which gas can move into and out of the pattern. Apertures 50 may contain porous inserts 48 as explained in connection with FIG. 2 or may be conventional vents. Alternatively apertures 50 may simply have a screen covering to prevent the escape of the sand mixture from the pattern. Such vents have been used in the past for allowing air to escape during the investment process when the pattern is charged with sand by means of compressed air. By properly locating the apertures they can be used to cause the catalyst gas to flow continuously into and out of the pattern and through the outer layer of the sand and binder mixture to cure that layer and form a hollow shell of conform thickness Alternatively baffles can be suitably arranged in the core box assembly to aid in causing the catalyst gas to flow along the inside of the pattern walls as illustrated in FIG. 4. By means of this dynamic gas flow a shell core will be formed having a uniform wall thickness and the core will be formed in a short amount of time. As illustrated in FIG. 5, catalyst gas molecules 56 will enter the pattern through apertures 54 in insert 48 and will then continuously flow along the pattern wall as illustrated by arrows 80 and will cause curing of the binder with which the sand granules 60 are coated. The advantages of this method and apparatus are that the cycle time is shortened and that a shell with uniform wall thickness will be produced. Furthermore, all of the advantages inherent in the cold box hollow core shell forming method will be achieved by this disclosed method.

Figure 6:
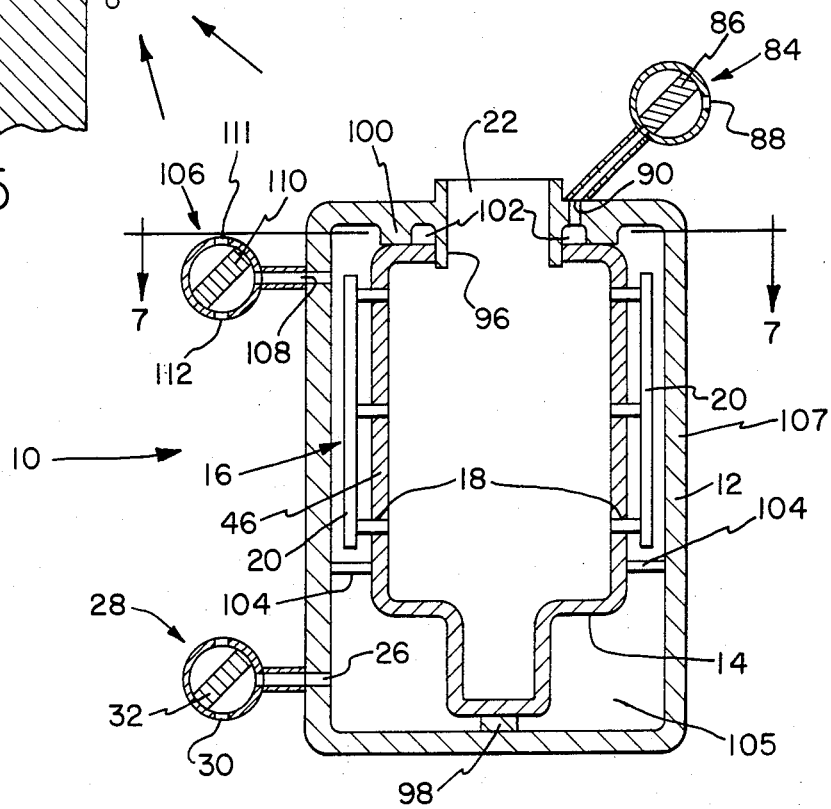
FIG. 6 is a cross-sectional view of a core box and pattern assembly.

Referring now to FIG. 6 a cross-sectional view of a core box assembly in accordance with the instant invention is disclosed including core box 12. Pattern 14 is shown inside core box 12. Pattern 14 includes apertures or vents as discussed hereinabove. The vents are strategically placed for the best gas flow pattern to produce a shell of uniform wall thickness in a short amount of time. A conventional ejection mechanism 16 is shown with ejector plates 20 and ejector pins 18 for ejecting finished shell cores from the pattern. An investment opening 22 is provided with an investment sleeve 96 as part of the core box. An inlet port valve assembly 28 is disclosed including inlet valve 32 for admitting catalyst gas into inlet port 26. A trapped gas vent is provided adjacent outlet port 90 including outlet valve assembly 84, adjacent outlet valve 86 and outlet valve port 88 for permitting catalyst gas flow from core box assembly 10. A pattern support 98 is shown for supporting pattern 14. Purging valve assembly 106 is disclosed including a purging valve 110 a purging valve inlet port 111 and a purging valve outlet port 112 to permit purging of air or gas through purging outlet port 108 from the core box assembly 10.

A baffle 100 is shown adjacent outlet port 90 and extending from the wall of core box 12 to the wall of pattern 14. Baffle 100 therefore forms an enclosed space or chamber 102 adjacent outlet port 90 which communicates with port 90. A baffle 104 is shown adjacent inlet port 26 and extending from the wall of core box 12 to the wall of pattern 14. Baffle 104 therefore establishes an enclosed space or chamber 105 which communicates with inlet port 26.

Figure 7:
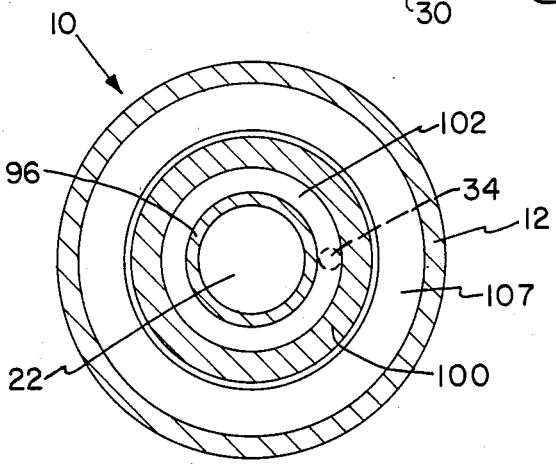
FIG. 7 is a cross-sectional view of a core box and pattern assembly taken along the line 7—7 of FIG. 6.

By referring now to FIG. 7 it can be seen that for purposes of illustration the core box assembly has been illustrated as being round. It should be understood that the core box assembly can have any desired shape. However, as seen in FIG. 6 and as further described hereinafter the inlet and outlet ports should be located so that laminar flow will be established inside pattern 14 for forming a hollow shell core and for causing substantially the entire outside surface of the invested sand and binder mixture to be contacted by catalyst gas as it flows from inlet port 26 to outlet port 90. It should also be understood that the strategic location of baffles 100 and 104 is important to cause the catalyst gas to flow from the inlet chamber 105 into the pattern and then to follow the pattern contours and to exit the pattern into the outlet chamber 102 from which it travels through outlet port 90 and through outlet valve assembly 84. While two baffles have been illustrated herein, the use of baffles, the number of baffles and the arrangement of the baffles is a matter of design choice. Thus, if a very complicated hollow shell core were to be fabricated whereby the pattern would have a complicated shape, a number of baffles might be necessary in order to cause the gas to flow so as to contact substantially the entire surface of the invested sand and binder mass for proper curing thereof. Alternatively for some shell cores no baffles would be needed.

While the process and apparatus to be described hereinafter in connection with FIGS. 8–14 and as disclosed in FIGS. 6 and 7 includes a core box, the process could be performed by means of an apparatus including only a pattern. The process operates by establishing a laminar flow of catalyst gas through the outer layer of the sand and binder mixture contained in a pattern. Thus, by referring to the diagrammatic representation shown in FIG. 4, by proper placement of inlets 74 and outlets 76 in a pattern and by controlling the laminar flow of the gas through the pattern by such placement, the process according to the instant invention can be practiced. The apparatus disclosed in FIGS. 6–14 utilizes the core box and baffles in order to aid in establishing the laminar flow of gas adjacent the pattern walls. By carefully controlling the pattern vent location, the placement of inlet and outlet ports and baffles in the core box, and the gas pressurization rate and flow, movement of the carrier gas can be maintained so that when the catalyst is released the gas is quickly carried to new sand and binder areas to be cured.

Figure 8:
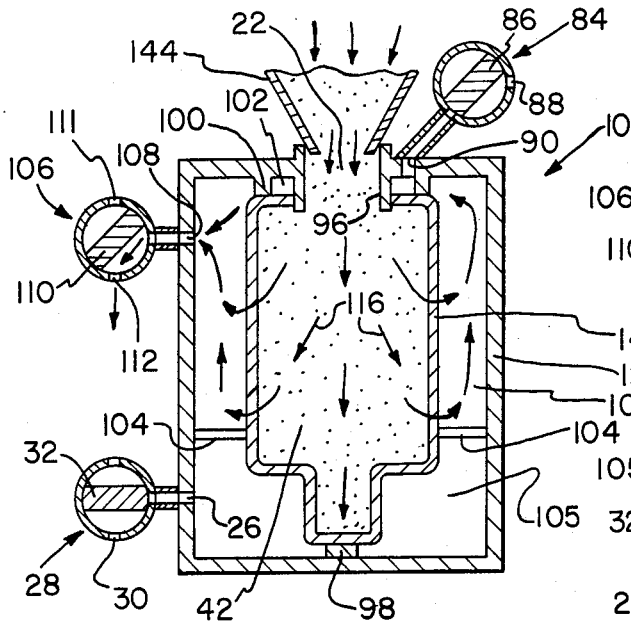
FIG. 8 is a schematic view of the first step of the process.

Referring now to FIGS. 8–14 the various steps in the operation of the core box assembly 10 are disclosed. FIG. 8 shows the core box assembly 10 in position to receive a charge of binder coated sand. An investment hopper or chute 144 is shown located above the investment opening 22 of the core box assembly whereby the binder coated sand can be charged through investment sleeve 96 of the core box assembly into pattern 14. The charging process may be accomplished by vibrating hopper 144 which causes the sand and binder mixture to flow through the hopper orifice. Alternatively, charging may be accomplished by means of compressed air. As mentioned hereinabove pattern 14 includes apertures through which air can pass out of pattern 14. As indicated by arrows 116 the air will flow through the pattern vents and out purging valve assembly 106. During this step purging valve 110 is placed in the open position as shown so that air can exit through valve port 112. During this time inlet port valve assembly 28 and outlet port valve assembly 84 are closed. Pattern support 98 supports pattern 14. It should be noted that the blowing of granular material by the force of compressed air into the pattern during charging of the pattern results in the needed density of the material to produce a uniform strong wall for the finished core shell. The charging step therefore not only causes the pattern cavity 14 to be filled with binder coated granular material but also causes the material to be compacted to increase its density. It should also be understood that compacting can be achieved by other means such as tamping rods.

After pattern 14 has been charged with binder coated sand, hopper 144 is removed and a seal 24 is placed in position to seal investment opening 22 thereby preventing binder coated sand from escaping from pattern 14. It should also be understood that sand cannot escape from pattern 14 through apertures 48 since the apertures are constructed in such a way so that only gas can escape therethrough.

Figure 9:
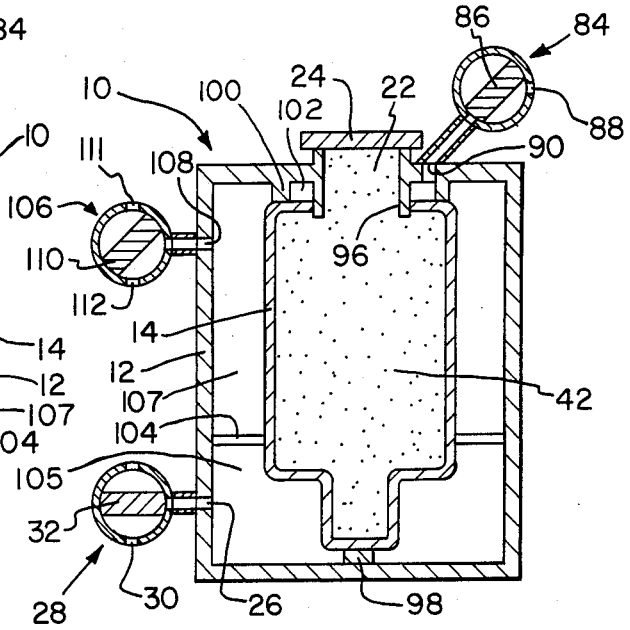
FIG. 9 is a schematic view of a the second step of the process.

By reference to FIGS. 8–14 it can be seen that the drawings are diagrammatic only and do not disclose all of the parts of the core box assembly. For instance, the ejector mechanism including ejector pins 18 and ejector plates 20 has been deleted from these drawings for the sake of clarity. In FIG. 9 it can be seen that inlet valve assembly 28 is closed as is outlet valve assembly 84 whereas purging valve assembly 106 remains open to allow air to exit through purging valve port 112. It can be seen by reference to FIGS. 6–14 that the particular arrangement of seal 24 and sleeve 96 can be varied to accommodate different requirements. Preferably the arrangement is such that the area inside sleeve 96 is not cured so that uncured sand binder mixture can be discharged from the cured shell after formation thereof.

As an additional step not illustrated herein, a warmup step could be provided for warming up the pattern walls by means of warm compressed air. Elevated temperatures of the pattern walls will aid in speeding up the curing of the sand and binder mixture in the presence of the catalyst gas.

Figure 10:
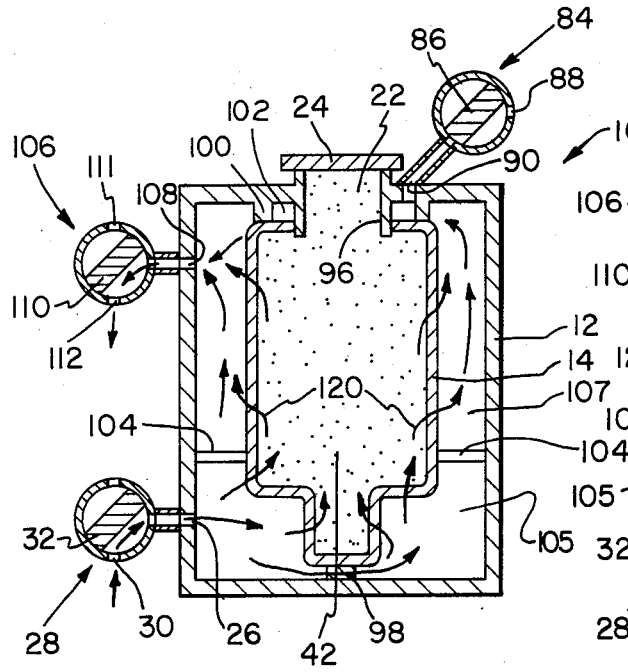
FIG. 10 is a schematic view of the third step of the process.

Referring now to FIG. 10 the next step in the process is shown. Outlet valve assembly 84 remains closed but inlet valve 28 is opened. Inlet valve 32 is opened and catalyst gas is admitted through valve inlet port 30 and core box inlet port 26. As indicated by arrows 120 the catalyst gas will flow from inlet port 26 into inlet space 105. Since the walls of pattern 14 have vents located therein the catalyst gas can move through the walls into pattern 14 as indicated by the arrows. Baffles 104 prevent gas from flowing from space 105 directly into space 107. Purging valve assembly 106 is still in the open position and outlet valve assembly 84 is still closed. Therefore the catalyst gas will be able to move out of pattern 14 through the walls thereof and into purging space 107 and from there through core box purging outlet port 108 and purging valve assembly 106 through purging valve outlet port 112. The purging step illustrated in FIG. 10 causes the pressurized catalyst gas to flush air out of core box assembly 10 by the strategic location of inlet baffle 104 and outlet baffle 100. The catalyst gas flows along the inside of the walls of pattern 14 and thereby primarily flushes out the air located along the outside layer of the charge of binder coated sand in pattern 14. This is important because the binder coated sand located toward the center of pattern 14 will not be contacted by catalyst gas and therefore will not have the tendency to cure. The purging step is significant because it will prevent harmful dilution of entering catalyst gas thereby ensuring proper curing of the binder coated sand as desired.

Figure 11:
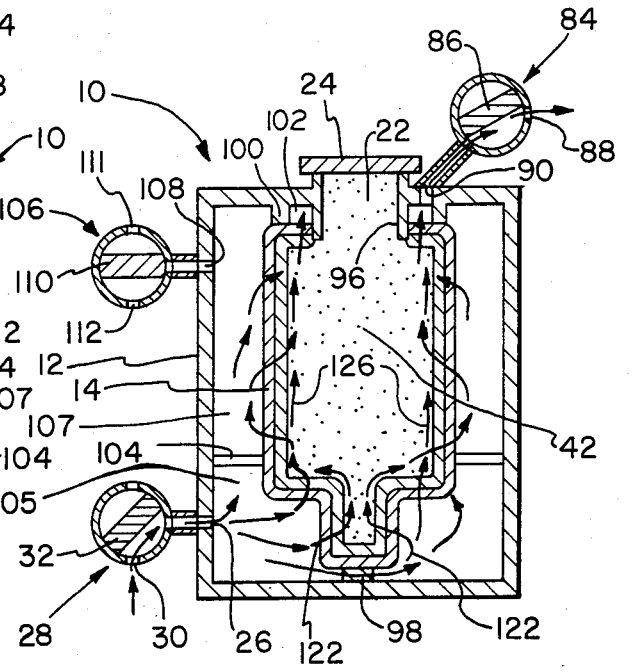
FIG. 11 is a schematic view of the fourth step of the process.

FIG. 11 illustrates the curing and gassing step of the process. At the beginning of this step purging valve 110 is closed, inlet valve 32 remains open and outlet valve 86 is opened. This repositioning of the valves rearranges the flow paths established in core box assembly 10. Continued delivery of catalyst gas through inlet port 26 and inlet valve assembly 28 permits gas to flow into inlet space 105. The gas will then flow through the vents in the pattern walls and into pattern 14 as indicated by arrows 122. As illustrated by arrows 126, gas will flow along the inside of the pattern walls following the path of least resistance and from there will flow through the walls at the top portion of the pattern and into outlet space 102. From space 102 the gas will flow through outlet port 90, outlet valve assembly 84 and valve outlet port 88. By the strategic placement of outlet baffle 100 and inlet baffle 104 the catalyst gas is forced to flow along only the outside layer of the binder coated sand in pattern 14. As illustrated by arrows 122 indicating the flow of gas, some of the gas may flow through the pattern wall at the bottom of the pattern and into purging space 107. However, this gas will reenter the pattern toward the top portion thereof as indicated by the arrows. The reason for the movement of gas out of the pattern into space 107 and back into the pattern is because of the existence of pressure differentials within the core box assembly. It should also be noted that the particular placement of baffles 100 and 104 is illustrative only and is not intended to show the exact location of the baffles for all possible patterns. Baffle location is dependent upon the particular configuration of the pattern and the location of the inlet and outlet valves in the core box assembly. The location of the baffles should be such that gas is forced to flow through only the outer layer of the binder coated sand in pattern assembly 14. As the gas flows through the outer layer, it will cure the binder coated sand as the catalyst molecules are stripped from the carrier by chemical reaction and are held chemically until the reaction is completed. The flow of gas through the pattern is controlled by the manipulation of valves 32 and 86 to allow the proper amount of gas flow to cause complete curing in a short amount of time. If thicker shell walls are desired, the flow of gas through valve 86 can be reduced to a trickle whereby the pressure of the catalyst gas inside pattern 14 will squeeze the air inside pattern 14 into a bubble at the center of pattern whereby shell thickness is increased. On the other hand if a thin shell is desired valve 86 can be opened to a greater extent so that the path of least resistance for the catalyst gas lies very close to the outside of the sand and binder mixture in pattern 14.

The polymerization or curing step illustrated in FIG. 11 is of shorter duration than that illustrated in the above described prior art processes since by the continuous flow of gas through the core box assembly it is ensured that fresh undiluted gas will quickly reach areas to be cured and will continuously contact the entire outside layer of the binder coated sand charge in pattern 14 whereby the curing time will be shortened. Furthermore, by causing the laminar flow of catalyst gas to cover the entire surface area of the binder coated sand charge in pattern 14 it is ensured that no weak shell areas of uncured sand will remain. Thirdly, since the process is not dependent upon diffusion of gas but is dependent on pressure differentials throughout the layer of binder coated sand the curing step is substantially shortened. It should also be noted that space 102 can conveniently be arranged so that no catalyst gas will contact binder coated sand in the vicinity of seal 24. By this arrangement it is possible to eliminate the need for a trimming tool and a trimming step to open up the top portion of pattern 14 prior to the discharge of uncured binder coated sand from the completed hollow core shell as further discussed hereinbelow.

One reason that the shells manufactured with the process according to the instant invention are stronger is that in the pressurized prior art processes discussed hereinabove the catalyst molecules are tied up very quickly by the binder coated sand as soon as they begin to penetrate into the sand. This is particularly true with an amine type of catalyst. To get better catalyst gas penetration higher pressures are needed which is also undesirable. However, with the continuous dynamic gas flow technique of the present invention fresh catalyst gas is continuously supplied so that additional catalyst molecules are supplied on a continuous basis which can therefore penetrate the binder coated sand further than with the prior art static pressure processes.

It should be understood that the patterns to be used with the process of the instant invention may be porous, similar to the patterns disclosed in the hereinbefore mentioned Michelson patent or may be conventional vented patterns, as long as a laminar continuous flow of gas is established along the inside of the pattern walls.

Figure 12:
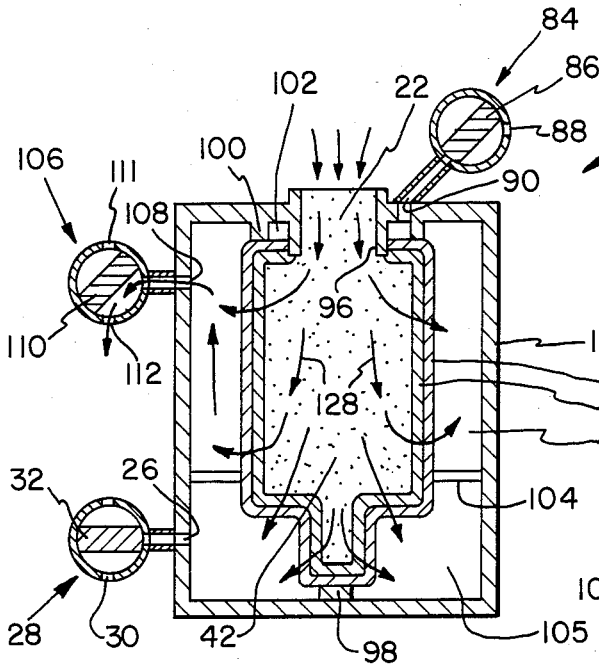
FIG. 12 is a schematic view of the fifth step of the process.
Figure 13:
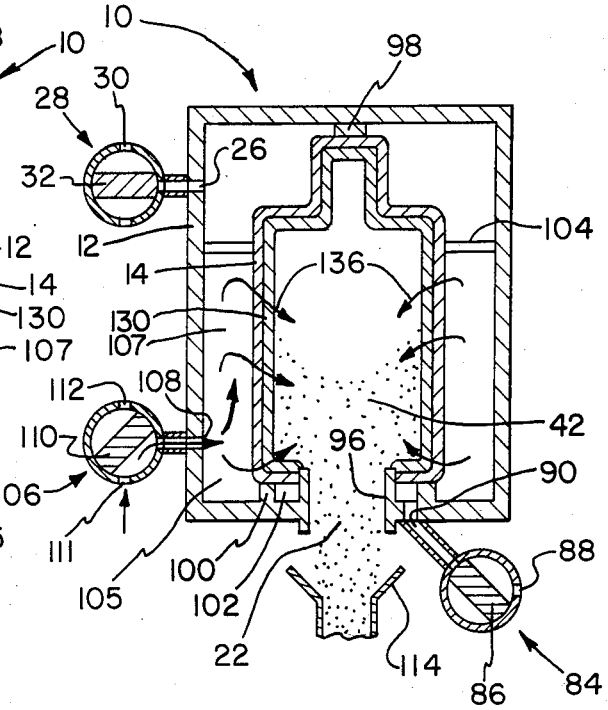
FIG. 13 is a schematic view of a sixth step of the process.
Figure 14:
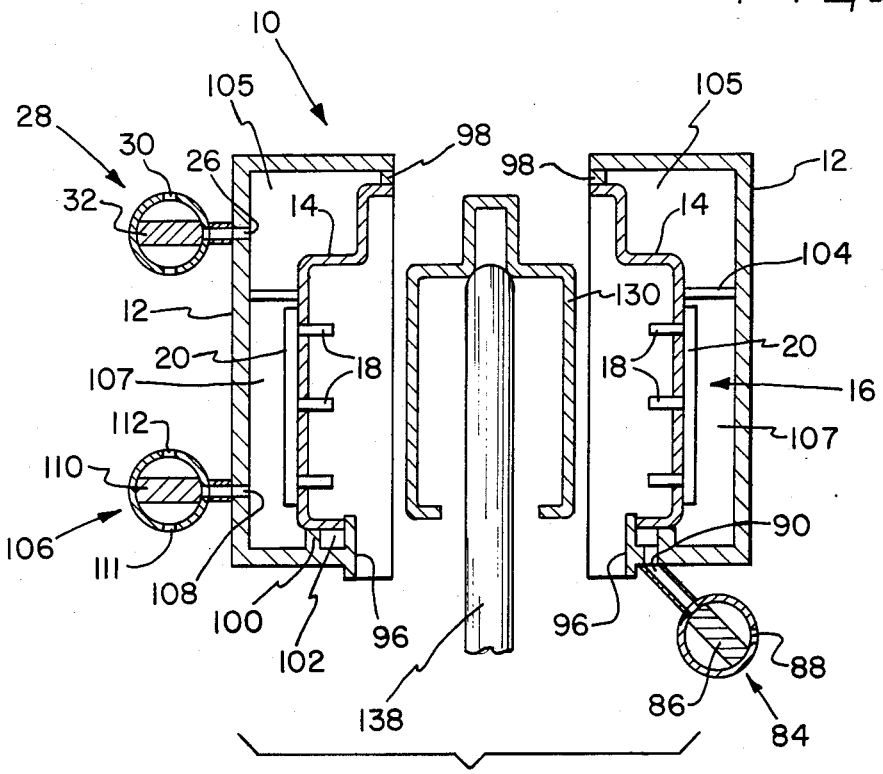
FIG. 14 is a schematic view of the seventh step of the process.

Referring now to FIG. 12, after curing of shell 130 seal 24 is removed from investment opening 22, valves 32 and 86 are closed and compressed air is supplied to investment opening 22 to flush out the catalyst gas remaining in the core box assembly. Valve 110 is opened during this step. After completion of the flushing operation the entire core box assembly is rotated 180° as illustrated in FIG. 13 whereby the uncured binder coated sand can be discharged from completed shell 130. During this step valve 110 is opened whereby compressed air can flow through port 108 into purging space 107 and from there through the vents of walls of pattern 14 to push loose binder coated sand toward the investment aperture 22. Hopper 114 is placed into position to receive the uncured binder coated sand after it leaves the core box assembly. The uncured binder coated sand can then be reused to manufacture additional core shells.

After discharge of the uncured binder coated sand completed shell 130 can be removed from core box assembly 10. As explained hereinabove the core box assembly consists of separable parts and as is well known in the prior art, these parts can be separated to allow removal of shell 130. A transfer rod 138 is first moved into the investment opening 22 to support the completed shell. Ejector plates 20 and ejector pins 18 are operated to loosen shell 130 from the pattern walls. The core box parts are moved apart a distance sufficient to allow the shell to be removed and as the box halves start their movement away from each other the ejection plates 20 remain in position thereby ejecting the shell from the pattern. After removal of the completed shell 130 the core box assembly is ready for the production of another shell. The core box halves are moved together again and the entire core box assembly is rotated 180° for preparation in receiving another charge of binder coated sand.

The rotating step can be eliminated by removing the uncured sand and binder material by means of compressed air while the pattern box retains the position shown in FIGS. 8–12. The elimination of the rotating step saves further cycle time.

While this invention has been described as having a preferred design it will understood that it is capable of further modification. This application is therefore intended to cover any variations, uses, or adaptations of the invention following the general principles thereof and including such departures from the present disclosure has come within known or customary practice in the art to which this invention pertains and fall within the limits of the appended claims.

What is claimed is:

1. A method for producing a hollow foundry core shell in a core box assembly including a core box having inlet and outlet ports and a pattern, said method comprising:

investing a hollow pattern with a charge of sand and binder mixture;

sealing said core box;

opening an inlet port;

introducing a catalyst gas into said core box through said inlet port;

establishing a flow of said gas from said inlet port to said outlet port and along the inside of the pattern walls through only the outer layer of said charge to thereby cure said outer layer of said charge and form a hollow shell;

removing uncured sand and binder mixture from said shell; and ejecting said shell from said pattern.

2. The method according to claim 1 including enclosing said pattern in said core box in spaced apart relationship thereto, providing apertures in the walls of said pattern to permit gas to pass through said walls, said inlet port positioned to admit gas into said core box, said outlet port positioned to cause said gas to flow said inlet port through said pattern walls and out of said outlet port to establish a continuous flow of said gas through said charge outer layer.

3. The method according to claim 2 including providing a baffle means in said core box for causing said gas to flow through said charge outer layer.

4. The method of claim 2 including arranging a baffle means in the enclosed space between the pattern and core box walls for causing said gas to flow through said outer layer.

5. The method according to claim 1 including the step of rotating said pattern for removing said uncured sand and binder mixture after curing of said outer layer.

6. The method according to claim 1 including the step of purging air from said pattern prior to the curing of said outer layer.

7. A method for producing a hollow foundry core shell comprising;

providing a sealable core box assembly including a core box and a pattern, the walls of said pattern including apertures and the walls of said core box including inlet and outlet ports for permitting ingress and egress of a catalyst gas into said assembly;

investing said pattern with binder coated sand;

sealing said core box assembly;

introducing said gas into said core box through said inlet port;

causing said gas to flow from said inlet port through said pattern to said outlet port to cure only the outside layer of the binder coated sand contained in said pattern and to cause said gas to flow out of said outlet port;

removing uncured binder coated sand from said shell; and ejecting said hollow shell from said pattern.

8. The method according to claim 7 and further including the step of rotating said pattern prior to removing said uncured sand and binder mixture.

9. The method according to claim 7 including providing said core box with a baffle member between said inlet and outlet ports to cause said gas to flow into said pattern through said apertures.

10. The method according to claim 7 including providing said box with two baffle members in the space between said core box walls and said pattern walls intermediate said inlet and outlet ports, the first of said baffles located adjacent said inlet port to cause said gas to pass through said apertures into said pattern and the second of said baffles located near said outlet port to cause said gas to pass from said pattern to said outlet port.

11. A method for making a hollow foundry core comprising:

providing a hollow core box and pattern assembly, the walls of said pattern including apertures therein to permit a gas to pass through said walls;

providing inlet and outlet ports in the walls of said core box;

forming the space between the wall of said core box and said pattern into a plurality of enclosed sections;

investing said pattern with a sand and binder mixture through an investment opening;

sealing said investment opening;

admitting a catalyst gas into said core box assembly through said inlet port;

opening said outlet port to permit said gas to flow continuously from said inlet port to said outlet port through a laminar region inside said pattern and adjacent said pattern walls to cure the outer layer of said sand and binder mixture contained in said pattern.

12. The method of according to claim 11 including opening a first of said sections to said inlet port and opening a second of said sections to said outlet port.

13. The method according to claim 11 including controlling the gas flow through said outlet port by means of a valve.

14. The method according to claim 11 including providing said core box wall with a purging valve and opening said purging valve to purge air from said core box assembly after said gas is admitted to said assembly.

15. The method according to claim 11 including the steps of unsealing said investment opening after said curing step;

rotating said core box assembly;

removing uncured sand and binder mixture from said pattern; and ejecting said hollow shell from said pattern.

16. A core box assembly for forming hollow foundry shell cores comprising:

a core box;

a pattern located in said core box, the walls of said pattern including apertures for permitting a catalyst gas to pass through said walls;

inlet port means and outlet port means in the walls of said core box;

baffle means in said core box intermediate said inlet and outlet ports for causing a catalyst gas, upon entering said inlet port, to flow into said pattern and along said pattern walls and out of said pattern into said core box and out of said outlet port.

17. The core box assembly according to claim 16 wherein said baffle means comprises a first baffle member located adjacent said inlet port and extending from the core box wall to the pattern wall.

18. The core box assembly according to claim 16 wherein said baffle means comprises a first baffle member located adjacent said inlet port and a second baffle member located adjacent said outlet port, said baffle members extending between the core box walls and the pattern walls, said baffle members establishing a flow path for said catalyst gas between said inlet and outlet ports including the region inside said pattern and adjacent said pattern walls.

19. The core box assembly according to claim 16 including valve means in said outlet port for controlling the rate of flow of gas therethrough.

20. A core box and pattern assembly for the heatless production of hollow shell cores comprising:

a sealable core box;

a pattern located in said core box to form a space between the walls of said pattern and the core box walls, the walls of said pattern constructed to permit a gas to pass therethrough;

gas inlet and outlet port means in said core box walls for establishing a flow path through said core box assembly for gas entering said inlet port means and exiting from said outlet port means, said flow path including the space inside said pattern immediately adjacent said pattern walls; and gas impermeable baffle means located in the space between said pattern walls and said core box walls, said baffle means dividing said space into a plurality of enclosed sections;

said inlet port means being located in one of said enclosed sections and said outlet port means being located in another one of said enclosed sections, said gas entering said pattern from said inlet port means and at least one of said enclosed sections, and said gas exiting said pattern through another of said enclosed sections and said outlet port means.

21. The core box assembly according to claim 20 wherein said baffle means comprises a baffle member located adjacent said outlet ports means, said member extending from said core box wall to said pattern wall and forming a chamber therewith, said outlet port means communicating with said chamber.

22. The core box assembly according to claim 20 wherein said baffle means comprises first and second baffle members, said first baffle member located adjacent said inlet port means and said second baffle member located adjacent said outlet port means, said first and second baffle members each extending between said core box walls and said pattern walls and forming enclosed first and second spaces therewith, the flow path of said gas comprising said inlet port means, said first enclosed space, said space along the inside of said pattern wall, said second enclosed space, and said outlet port means.

23. The core box assembly according to claim 20 and including a purging port in said core box wall in one of said sections.

24. The core box assembly according to claim 23 including valve means located in said outlet port means for controlling the flow of gas through said outlet port means.

25. A method for producing hollow foundry core shells comprising:

providing a hollow pattern including a plurality of openings;

investing said pattern with a charge of sand and binder mixture;

introducing a catalyst gas into said pattern through at least two of said plurality of said openings;

flowing said gas through only the outer layer of said sand and binder mixture and then out of at least two of said plurality of openings to thereby cure the outer layer of said sand and binder mixture and to form a hollow shell thereby;

removing uncured sand and binder mixture from said shell; and removing said shell from said pattern.

26. The method according to claim 25 including controlling said flow of gas through said openings with a valve means.

27. The method according to claim 25 wherein a gas pressure differential exists across said pattern.

* * * * *

UNITED STATES PATENT AND TRADEMARK OFFICE

CERTIFICATE OF CORRECTION

PATENT NO. : 4,628,983

DATED : December 16, 1986

INVENTOR(S) : Gary L. Myers et al

It is certified that error appears in the above-identified patent and that said Letters Patent is hereby corrected as shown below:

In the Title, delete "SHEEL" and insert therefor --SHELL--;
In the Abstract, line 8, change "change" to --charge--;
Col. 5, line 56, change "mix-ture" to --mixture--;
Claim 2, Col. 14, line 3, after "flow" insert --from--;
Claim 25, Col. 16, line 50, before "openings" delete "said".

Signed and Sealed this

Eighteenth Day of August, 1987

*Attest:*

DONALD J. QUIGG

*Attesting Officer*

*Commissioner of Patents and Trademarks*